US009490583B2

(12) United States Patent
Huo et al.

(10) Patent No.: US 9,490,583 B2
(45) Date of Patent: Nov. 8, 2016

(54) LVDS CONNECTOR

(71) Applicant: Shenzhen Deren Electronic Co., Ltd, Shenzhen (CN)

(72) Inventors: ZhuDong Huo, Shenzhen (CN); GuoFeng Peng, Shenzhen (CN)

(73) Assignee: Shenzhen Deren Electronic Co., Ltd., Shenzhen (CN)

( * ) Notice: Subject to any disclaimer, the term of this patent is extended or adjusted under 35 U.S.C. 154(b) by 38 days.

(21) Appl. No.: 14/554,225

(22) Filed: Nov. 26, 2014

(65) Prior Publication Data

US 2015/0200494 A1 Jul. 16, 2015

Related U.S. Application Data

(63) Continuation of application No. PCT/CN2014/087189, filed on Sep. 23, 2014.

(30) Foreign Application Priority Data

Jan. 14, 2014 (CN) ..... 2014 2 0022557 U
Jan. 14, 2014 (CN) ..... 2014 2 0023397 U

(51) Int. Cl.

| | |
|---|---|
| ***H01R 13/6581*** | (2011.01) |
| ***H01R 12/79*** | (2011.01) |
| ***H01R 12/62*** | (2011.01) |
| ***H01R 12/52*** | (2011.01) |
| ***H01R 13/6591*** | (2011.01) |
| ***H01R 12/71*** | (2011.01) |
| *H01R 12/72* | (2011.01) |

(52) U.S. Cl.

CPC ..... *H01R 13/6581* (2013.01); *H01R 12/52* (2013.01); *H01R 12/62* (2013.01); *H01R 12/716* (2013.01); *H01R 12/79* (2013.01); *H01R 13/6591* (2013.01); *H01R 12/722* (2013.01)

(58) Field of Classification Search

CPC ..... H01R 12/62; H01R 12/79; H01R 12/52; H01R 12/716; H01R 13/6591; H01R 13/6581

USPC ..... 439/607.55

See application file for complete search history.

(56) References Cited

U.S. PATENT DOCUMENTS 8,292,662 B2 * 10/2012 Yang ..... H01R 13/5202 439/271
2009/0298340 A1 * 12/2009 Li ..... H01R 13/6658 439/620.22
2010/0216342 A1 * 8/2010 Lin ..... H01R 4/023 439/607.49

FOREIGN PATENT DOCUMENTS

CN 201112727 Y 9/2008
CN 202231194 U 5/2012

(Continued)

*Primary Examiner* — Abdullah Riyami
*Assistant Examiner* — Justin Kratt
(74) *Attorney, Agent, or Firm* — Ladas & Parry LLP

(57) ABSTRACT

An LVDS connection comprises: a plurality of conductive terminals, an insulative housing, a shielding housing, and a first plastic body, each conductive terminal comprising a base portion and an elastic contact portion, and the insulative housing comprising a base body and base body end portions, wherein the plurality of conductive terminals are respectively inlaid and are insert molding on the base body, and the elastic contact portion extends out of a front side face of the insulative housing in a suspension manner. The plurality of conductive terminals and the insulative housing are inlaid and thus insert molding. The shielding housing comprises the first housing, the second housing, and the bending portion, wherein the bending portion is bent to form a receiving space with the first housing and the second housing. The insulative housing is assembled in the receiving space.

19 Claims, 3 Drawing Sheets

(56) References Cited

FOREIGN PATENT DOCUMENTS

| | | | |
|---|---|---|---|
| CN | 202373769 | U | 8/2012 |
| CN | 203103608 | U | 7/2013 |
| CN | 103779693 | A | 5/2014 |
| CN | 203787640 | U | 8/2014 |

* cited by examiner

LVDS CONNECTOR

This application is a continuation of International Application No. PCT/CN2014/087489, filed Sep. 23, 2014, which claims priority to Chinese Patent Application No. 201420023397.1, and 201420022557.0, filed Jan. 14, 2014, three of which are hereby incorporated by reference in their entireties.

TECHNICAL FIELD

The present invention relates to the technical field of connectors, and particularly relates to an LVDS connector.

BACKGROUND

Low-voltage differential signaling (LVDS) connectors are mainly applicable to signal transmission for liquid crystal displays. The LVDS connector transmits data via differential signaling over two PCB wirings or a pair of balanced cables by using a very low voltage swing (about 350 mV), that is, the low-voltage differential signaling transmission. With an LVDS connector, signals may be transmitted over a differential PCB wire or a balanced cable at a rate of several hundreds of Mbit/s. Since low-voltage and low-current driving is employed, low noise and low power consumption is achieved. The LVDS connectors are widely applied on liquid crystal displays over 17 inches.

A conventional LVDS connector comprises a shielding housing, an insulative housing, and a plurality of conductive terminals. The plurality of conductive terminals are assembled and inserted into the insulative housing. The shielding housing secures and covers the insulative housing via a buckling structure, thereby forming a jack space for coupling or connecting an external plug. Due to restrictions on the production specifications, the insulative housing is thin and elongated. When the conductive terminals are assembled and inserted into the insulative housing, the overall strength of the insulative housing is insufficient such that the conductive terminals are subject to looseness or deformations. Further, the shielding housing needs to be firstly formed by means of stamping, and then is assembled on to the insulative housing via a buckling structure. The entire process is complicated and takes long to complete the assembling, which is thus unfavorable to improvement of the production efficiency.

SUMMARY

In view of the above, to solve the problems that the conductive terminals are easily subject to looseness or warping and the production efficiency is low, it is necessary to provide an LVDS connector capable of preventing the conductive terminals from looseness or warping and improving the production efficiency.

An LVDS connector is provided, comprising:

a plurality of conductive terminals, each of the plurality of conductive terminals comprising a base portion and an elastic contact portion formed by extending from one end of the base portion, the elastic contact portion being configured to be electrically connected to an external plug;

an insulative housing, comprising a base body and base body end portions positioned on two ends of the base body, the plurality of conductive terminals being inlaid and insert molding on the base body, the elastic contact portion extending out of a front side face of the insulative housing in a suspension manner;

a shielding housing, comprising a first housing, a bending portion, and a second housing, the first housing and the second housing being connected via the bending portion and thereby forming a receiving space, the insulative housing being assembled in the receiving space, the bending portion being in contact with the base body end portions; and a first plastic body, insert molding on an inner side of the first housing, the first plastic body being configured to space apart the plurality of conductive terminals to prevent short circuit.

In one embodiment of the present invention, a plurality of spacing bars protrude and are thus formed on a surface of the first plastic body back to the first housing, a groove for receiving the elastic contact portion of each of the plurality of conductive terminals being formed between each two adjacent spacing bars of the plurality of spacing bars.

In one embodiment of the present invention, the LVDS connector further comprises a second plastic body, the second plastic body is insert molding on an outer side of the second housing and configured to space apart the shielding housing and an external PCB.

In one embodiment of the present invention, the base body end portion is provided with a locating hole and a guide sliding groove communicated with the locating hole, and a holding pad is insert molding on the first housing, the holding pad being inserted along the guide sliding groove into the locating hole to assemble and locate the insulative housing on the shielding housing.

In one embodiment of the present invention, a tin pin securing groove is further formed on a bottom face of the base body end portion, and a tin pin for welding is formed on the second housing, the tin pin being securely located in the tin pin securing groove, the tin pin securing groove being a tapered securing groove, and a width of the tin pin securing groove gradually decreasing along a direction where the tin pin is inserted into the tin pin securing groove.

In one embodiment of the present invention, the front side face of the insulative housing is provided with a locating groove, and a locating block mating with the locating groove is formed on a rear side face of the first plastic body.

In one embodiment of the present invention, the locating groove comprises a first locating groove, the first locating groove being an upwardly open groove; and the locating block comprises a first locating block and a second locating block, the first locating block being aligned with a top face of the insulative housing or a top face of the first plastic body to mate with the first locating groove, and the second locating block being lower than the top face of the insulative housing or the top face of the first plastic body to mate with the first locating groove.

In one embodiment of the present invention, a locating block protrudes and is thus formed on the front side face of the insulative housing, and a locating groove mating with the locating block is formed on a rear side face of the first plastic body.

In one embodiment of the present invention, the locating block comprises a first locating block and a second locating block; and the locating groove comprises a first locating groove and a second locating groove, the first locating block mating with the first locating groove, and the second locating block mating with the second locating groove.

In one embodiment of the present invention, a bottom face of the insulative housing is provided with a holding groove, and a holding pad mating with the holding groove is formed on the second housing.

In one embodiment of the present invention, the holding groove comprises a first holding groove and a second holding groove, the first holding groove being an upwardly open groove, the second holding groove being a downwardly open groove, and a width of the second holding groove being greater than a width of the first holding groove; and the holding pad comprises a first holding pad and a second holding pad, the first holding pad and the second holding pad being both aligned with the second housing, and a width of the second holding pad being greater than a width of the first holding pad.

In one embodiment of the present invention, a holding pad protrudes and is thus formed on a bottom face of the insulative housing, and a holding groove mating with the holding pad is formed on the second housing.

In one embodiment of the present invention, the holding pad comprises a first holding pad and a second holding pad, the first holding pad and the second holding pad being staggered arranged, the first holding pad being aligned with the bottom face of the insulative housing, and the second holding pad being aligned with the bottom face of the insulative housing; and the holding groove comprises a first holding groove and a second holding groove, the first holding groove and the second holding groove being staggered arranged, the first holding groove being an upwardly open groove, and the second holding groove being a downwardly open groove.

In one embodiment of the present invention, a locating block protrudes and is thus formed on an outer side face of the base body end portion back to another base body end portion.

In one embodiment of the present invention, a securing grapnel mating with a docking connector is formed on each of two ends of the first housing.

In one embodiment of the present invention, a contact shrapnel is formed by inward extension towards the receiving space on one side of the bending portion.

In one embodiment of the present invention, a flat plate-shaped structure is formed by upward extension on the second housing, the flat plate-shaped structure being provided with a buckling piece; and a buckling hole mating with the buckling piece is formed by downward extension on the first housing.

In one embodiment of the present invention, a securing piece is formed by extension at a rear end of the first housing; and a second locating groove mating with the securing piece is arranged on the insulative housing, the second locating groove being a downwardly open groove.

A connector is provided, comprising:

a plurality of conductive terminals, each of the plurality of conductive terminals comprising a base portion and an elastic contact portion formed by extending from one end of the base portion, the elastic contact portion being configured to be electrically connected to an external plug;

an insulative housing, on which the plurality of conductive terminals are inlaid and insert molding, the elastic contact portion extending out of a front side face of the insulative housing in a suspension manner, a shielding housing, comprising a receiving space, the insulative housing being assembled in the receiving space; and a first plastic body, insert molding on an inner side of the shielding housing, the first plastic body being configured to space apart the plurality of conductive terminals to prevent short circuit.

The LDVS connector has at least the following advantages:

The plurality of conductive terminals and the insulative housing are inlaid and thus insert molding. The shielding housing comprises the first housing, the second housing, and the bending portion, wherein the bending portion is bent to form a receiving space. The insulative housing is assembled in the receiving space. The first plastic body is insert molding with the first housing of the shielding housing. In this way, the problems that the plastic on the upper side of the receiving space of the thin elongated connector is subject to a dent and the overall strength is insufficient are solved. The first plastic body mates with the insulative housing to achieve assembling and securing. In this way, the complicated process of assembling is saved and the production efficiency is improved. The conductive terminal and the insulative housing are inlaid and thus insert molding. This improves the strength of the insulative housing and prevents the conductive terminal from the phenomenon of looseness and warping in case of collisions.

DETAILED DESCRIPTION

To make the objectives, features, and advantages of the present invention clearer and more understandable, the present invention is described in detail with reference to attached drawings and specific embodiments. Details are given in the following description for better understanding of the present invention. However, the present invention may be implemented in a plurality of embodiments different from those described herein, and a person skilled in the art may make similar derivations without departing from the essence of the present invention. Therefore, the present invention is not subjected to limitations of the specific embodiments disclosed hereinafter.

It should be noted that, when an element is defined as "being secured to" another element, the element may be directly on the another element or a centered element may be present. When an element is defined as "being connected or coupled to" another element, the element may be directly connected or coupled to the another element or a centered element may be present. As used herein, the terms "vertical", "horizontal", "left", "right", and similar expressions are for illustration purposes, and do not denote the only embodiments.

Unless the context clearly requires otherwise, throughout the description and the claims, the terms "comprise", "comprising" and the like are to be construed in an inclusive sense as opposed to an exclusive or exhaustive sense; that is to say, in the sense of "including, but not limited to". Words using the singular or plural number also include the plural or singular number respectively. Additionally, the terms "herein", "above", "below" and similar terms when used in the present application, shall refer to this application as a whole and not to any particular portions of this application.

As used herein, the term "and/or" in reference to a list of two or more items covers all of the following interpretations of the term: any of the items in the list, all of the items in the list and any combination of the items in the list.

Figure 1:
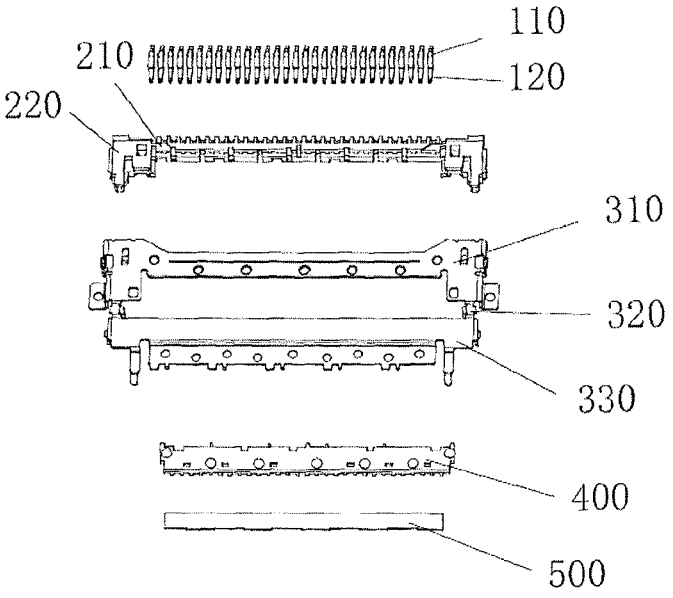
FIG. 1 is a schematic exploded view of an LVDS connector according to an embodiment of the present invention.

Referring to FIG. 1, a schematic exploded view of an LVDS connector 10 according to an embodiment of the present invention is given. The LVDS connector is mainly used for signal transmission for a liquid crystal display. The LVDS connector 10 comprises: a plurality of conductive terminals 100, an insulative housing 200, a shielding housing 300, a first plastic body 400, and a second plastic body 500.

Each of the plurality of conductive terminals 100 comprises a base portion 110 and an elastic contact portion 120 formed by extending from one end of the base portion 110, wherein the elastic contact portion 120 is configured to be electrically connected to an external plug. In this embodiment, the conductive terminal 100 is formed by stamping using a metal material.

Figure 2:
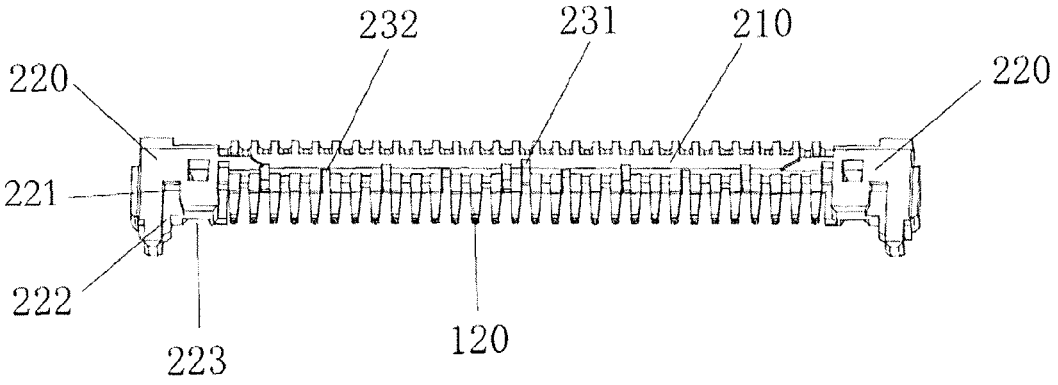
FIG. 2 is a schematic structural view of a conductive terminal and an insulative housing in FIG. 1.
Figure 3:
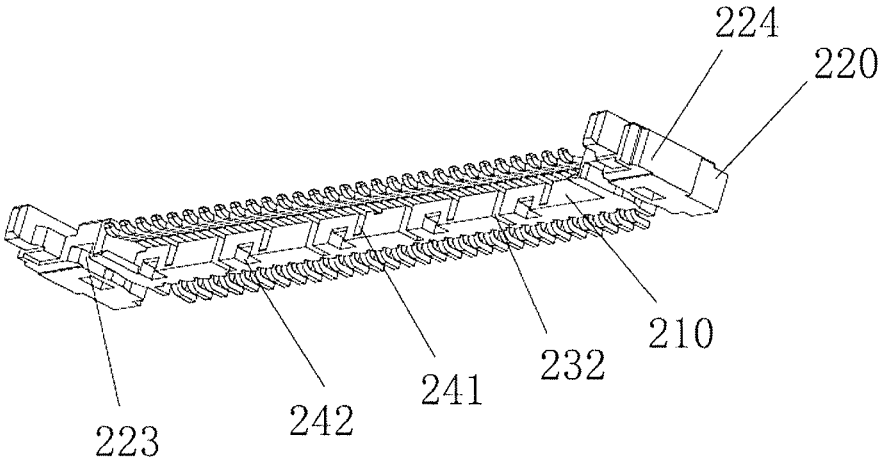
FIG. 3 is a schematic structural view of the conductive terminal and the insulative housing in FIG. 2 taken from another perspective.

The insulative housing 200 is formed by injection using an insulating plastic material. The insulative housing 200 comprises a base body 210 and base body end portions 220 positioned at two ends of the base body 210. The base body 210 is substantially in a cuboid structure, and the plurality of conductive terminals 100 are inlaid and insert molding on the base body 210. The direction towards which the elastic contact portion 120 of the conductive terminal 100 faces is defined as a forward direction, and the elastic contact portion 120 extends out of a front side face of the insulative housing 200 in a suspension manner Referring to FIG. 2 and FIG. 3, the base body end portion 220 is provided with a locating hole 221 and a guide sliding groove 222 communicated with the locating hole 221. A tin pin securing groove 223 is further formed on a bottom face of the base body end portion 220. Specifically, the tin pin securing groove 223 may be a tapered securing groove, and a width of the tin pin securing groove 223 gradually decreases along a direction where a tin pin 331 is inserted into the tin pin securing groove 223, which is favorable to securing of the tin pin 331 and locating of the tin pin 331, thereby ensuring flatness of the welding.

The front side face of the insulative housing 200 is provided with a locating groove 230. In this embodiment, the locating groove 230 comprises a plurality of first locating grooves 231 and a plurality of second locating grooves 232, wherein the first locating groove 231 and the second locating groove 232 are staggered arranged. The first locating groove 231 is an upwardly open groove and the second locating groove 232 is a downwardly open groove, thereby achieving up-and-down staggered securing. Nevertheless, in other embodiments, a locating block may be formed on the front side face of the insulative housing. The locating block comprises a plurality of first locating blocks and a plurality of second locating blocks, wherein the first locating block and the second locating block are staggered arranged. The first locating block is aligned with a top face of the insulative housing, and the second locating block is lower than the top face of the insulative housing.

The bottom face of the insulative housing 200 is further provided with a holding groove 240. In this embodiment, the holding groove 240 comprises a plurality of first holding grooves 241 and a plurality of second holding grooves 242, wherein the first holding groove 241 and the second holding groove 242 are staggered arranged. The first holding groove 241 is an upwardly open groove, the second holding groove 242 is a downwardly open groove, and a width of the second holding groove 242 is greater than a width of the first holding groove 241, thereby achieving up-and-down staggered securing. Nevertheless, in other embodiments, a holding pad may be formed on the bottom face of the insulative housing. The holding pad comprises a plurality of first holding pads and a plurality of second holding pads, wherein the first holding pad and the second holding pad are staggered arranged. The first holding pad is aligned with the bottom face of the insulative housing, and the second holding pad is aligned with the bottom face of the insulative housing.

A locating block 224 protrudes and is thus formed on an outer side face of the base body end portion 220 back to another base body end portion 220. To be specific, a locating block 224 protrudes and is thus formed on the outer side face of the left base body end portion 220 back to the right base body end portion 220, and a locating block 224 protrudes and is thus formed on the outer side face of the right base body end portion 220 back to the left base body end portion 220.

Figure 4:
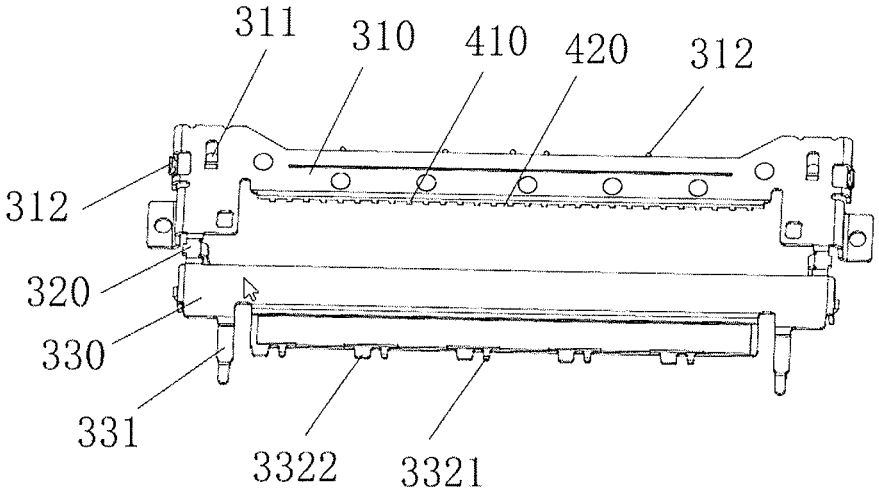
FIG. 4 is a schematic structural view of an unbent shielding housing in FIG. 1.
Figure 5:
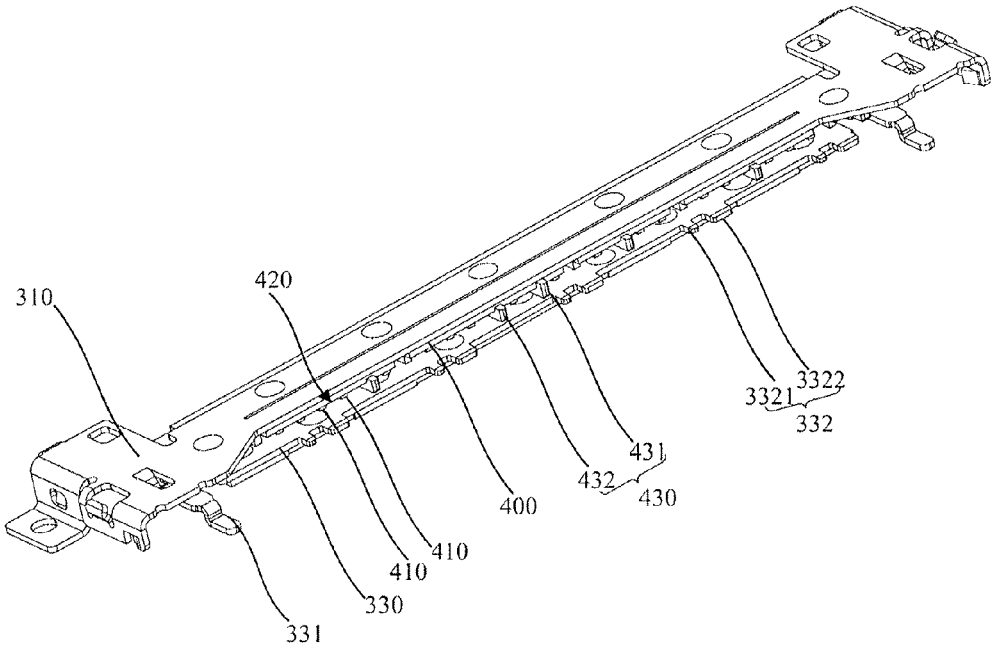
FIG. 5 is a schematic structural view of a bent shielding housing in FIG. 4.

Referring to FIG. 4 and FIG. 5, the shielding housing 300 comprises: a first housing 310, a bending portion 320, and a second housing 330. The first housing 310 and the second housing 330 are connected via the bending portion 320 and thus form a receiving space (not illustrated in the drawings). The insulative housing 200 is assembled into the receiving space, and the bending portion 320 is in contact with the base body end portion 220.

A holding pad 311 is insert molding on the first housing 310, wherein the holding pad 311 is inserted along the guide sliding groove 222 into the locating hole 221 to assemble and locate the insulative housing 200 on the shielding housing 300. A yin oin 331 for welding is formed on the second housing 330, wherein the tin pin 331 is securely located in the tin pin securing groove 223. A securing grapnel 312 mating with a docking connector is formed on each of two ends of the first housing 310.

A first plastic body 400 is insert molding on an inner side of the first housing 310, and the first plastic body 400 is configured to space apart the plurality of conductive terminals 100 to prevent short circuit. In this embodiment, a plurality of spacing bars 410 protrude and are thus formed on a surface of the first plastic body 400 back to the first housing 310, wherein a groove 420 is formed between each two adjacent spacing bars of the plurality of spacing bars 410, and the elastic contact portion 120 of each of the plurality of the conductive terminals 100 is received in the groove 420.

A locating block 430 mating with the locating groove 230 is formed on a rear side face of the first plastic body 400. In this embodiment, the locating block 430 comprises a plurality of first locating blocks 431 and a plurality of second locating blocks 432, wherein the first locating block 431 and the second locating block 432 are staggered arranged. The first locating block 431 is aligned with a top face of the first plastic body 400 to mate with the first locating groove 231, and the second locating block 432 is lower than the top face of the first plastic body 400 to mate with the first locating groove 231. Nevertheless, in other embodiments, a locating groove may be formed on a rear side face of the first plastic body.

A holding pad 332 mating with the holding groove 240 is formed on the second housing 330. In this embodiment, the holding pad 332 comprises a plurality of first holding pads 3321 and a plurality of second holding pads 3322, wherein the first holding pad 3321 and the second holding pad 3322 are staggered arranged. The first holding pad 3321 and the second holding pad 3322 are both aligned with the second housing 330, and a width of the second holding pad 3322 is greater than a width of the first holding pad 3321, thereby achieving up-and-down staggered securing. Nevertheless, in other embodiments, a holding groove may be formed on a bottom face of the second housing. The holding groove comprises a plurality of first holding grooves and a plurality of second holding grooves, wherein the first holding groove and the second holding groove are staggered arranged. The first holding groove is an upwardly open groove, and the second holding groove is a downwardly open groove.

The second plastic body 500 is insert molding on an outer side of the second housing 330, and is configured to space apart the shielding housing 300 and an external PCB to prevent short circuit between the shielding housing 300 and the external PCB.

Figure 6:
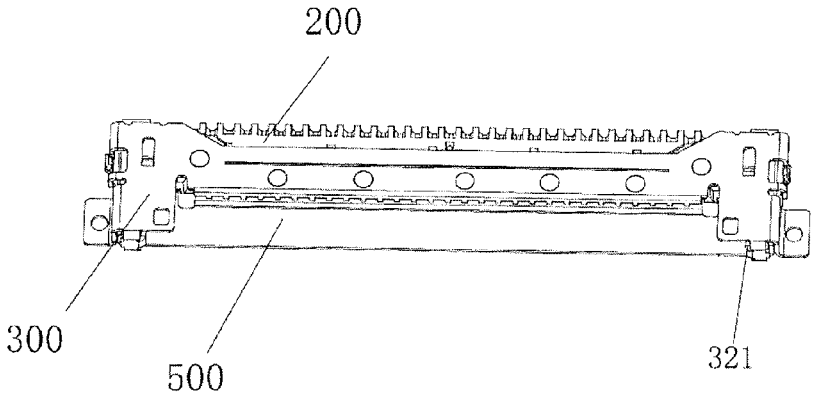
FIG. 6 is a schematic structural view of an assembled LVDS connector.

Referring to FIG. 6, during assembling, the front side face of the insulative housing 200 on which the conductive terminal 100 is inlaid and insert molding is made to be in contact with the shielding housing 300 on which the first plastic body 400 is insert molding, such that the first housing 310 and the second housing 320 both abut against the front side face of the insulative housing 200. In this way, the elastic contact portion 120 of the conductive terminal 100 is received in the groove 420 formed between the spacing bars 410, such that the first locating block 431 is inserted into the first locating groove 231, the second locating block 432 is inserted into the first locating groove 231, the first holding pad 3321 is inserted into the first holding groove 241, and the second holding pad 3322 is inserted into the second holding groove 242, thereby achieving up-and-down staggered securing. With such arrangement, the insulative housing 200 is subjected to a uniform force and is thus secured reliably.

The LVDS connector 10 has at least the following advantages:

The plurality of conductive terminals 100 and the insulative housing 200 are inlaid and thus insert molding. The shielding housing 300 comprises the first housing 310, the second housing 330, and the bending portion 320, wherein the bending portion 320 is bent to form a receiving space. The insulative housing 200 is assembled in the receiving space. The first plastic body 400 and the first housing 310 of the shielding housing 300 are insert molding. In this way, the problems that the plastic on the upper side of the receiving space of the thin elongated connector is subject to a dent and the overall strength is insufficient are solved. A plurality of grooves 420 are formed on the surface of the first plastic body 400 back to the first housing 310. The conductive terminal 100 is received in the groove 420. The first plastic body 400 concave-and-convex mates with the insulative housing 200 to achieve assembling and securing. In this way, the complicated process of assembling is saved and the production efficiency is improved. The conductive terminal 100 and the insulative housing 200 are inlaid and thus insert molding. This improves the strength of the insulative housing 200 and prevents the conductive terminal 100 from the phenomenon of looseness and warping in case of collisions.

In the embodiments of the present invention, upon completion of assembling, the first housing 310 and the second housing 320 abut against the locating block 224, thereby preventing the first housing 310 and the second housing 320 from moving towards the front end.

In the embodiments of the present invention, a contact shrapnel 321 in contact with the metal housing of the docking connector is formed by inward extension towards the receiving space on one side of the bending portion 320.

In the embodiments of the present invention, a flat plate-shaped structure is formed by upward extension on the second housing 330, wherein the flat plate-shaped structure is provided with a buckling piece 331; and a buckling hole 311 mating with the buckling piece 331 is formed by downward extension on the first housing 310. The engagement of the buckling hole 311 and the buckling piece 331 prevents the separation of the first housing 310 from the second housing 330.

In the embodiments of the present invention, a securing piece 312 is formed by extension at a rear end of the first housing 310; and a second locating groove 232 mating with the securing piece 312 is arranged on the insulative housing 200.

An embodiment of the present invention further provides a connector, comprising:

a plurality of conductive terminals, each of the plurality of conductive terminals comprising a base portion and an elastic contact portion formed by extending from one end of the base portion, the elastic contact portion being configured to be electrically connected to an external plug;

an insulative housing, on which the plurality of conductive terminals are inlaid and insert molding, the elastic contact portion extending out of a front side face of the insulative housing in a suspension manner;

a shielding housing, comprising a receiving space, the insulative housing being assembled in the receiving space; and a first plastic body, insert molding on an inner side of the shielding housing, the first plastic body being configured to space apart the plurality of conductive terminals to prevent short circuit.

Described above are merely several exemplary embodiments for illustration of the present invention, which are specifically described in detail. However, these embodiments shall not be construed as limitations to the scope of the present invention. It should be noted that persons of ordinary skill in the art may derive various variations and modifications without departing from the inventive concept of the present disclosure. Such variations and modifications shall pertain to the protection scope of the present disclosure. Therefore, the protection scope of the present invention is subject to what defined by the appended claims.

What is claimed is:

1. A low-voltage differential signaling (LVDS) connector, comprising:

a plurality of conductive terminals, each of the plurality of conductive terminals comprising a base portion and an elastic contact portion formed by extending from one end of the base portion, the elastic contact portion being configured to be electrically connected to an external plug;

an insulative housing, comprising a base body and base body end portions positioned on two ends of the base body, the plurality of conductive terminals being inlaid and insert molded on the base body, the elastic contact portion extending out of a front side face of the insulative housing in a suspension manner;

a shielding housing, comprising a first housing, a bending portion, and a second housing, the first housing and the second housing being connected via the bending portion and thereby forming a receiving space, the insulative housing being assembled in the receiving space, the bending portion being in contact with the base body end portions; and a first plastic body, insert molded on an inner side of the first housing, the first plastic body being configured to space apart the plurality of conductive terminals to prevent a short circuit; wherein a securing grapnel mating with a docking connector is formed on each of two ends of the first housing.

2. The LVDS connector according to claim 1, wherein a plurality of spacing bars protrude and are thus formed on a surface of the first plastic body back to the first housing, a groove for receiving the elastic contact portion of each of the plurality of conductive terminals being formed between each two adjacent spacing bars of the plurality of spacing bars.

3. The LVDS connector according to claim 2, further comprising a second plastic body, the second plastic body is insert molded on an outer side of the second housing and configured to space apart the shielding housing and an external printed circuit board (PCB).

4. The LVDS connector according to claim 2, wherein the base body end portion is provided with a locating hole and a guide sliding groove communicated with the locating hole, and a holding pad is insert molded on the first housing, the holding pad being inserted along the guide sliding groove into the locating hole to assemble and locate the insulative housing on the shielding housing.

5. The LVDS connector according to claim 4, wherein a tin pin securing groove is further formed on a bottom face of the base body end portion, and a tin pin for welding is formed on the second housing, the tin pin being securely located in the tin pin securing groove, the tin pin securing groove being a tapered securing groove, and a width of the tin pin securing groove gradually decreasing along a direction where the tin pin is inserted into the tin pin securing groove.

6. The LVDS connector according to claim 1, wherein the front side face of the insulative housing is provided with a locating groove, and a locating block mating with the locating groove is formed on a rear side face of the first plastic body.

7. The LVDS connector according to claim 6, wherein: the locating groove comprises a first locating groove, the first locating groove being an upwardly open groove; and the locating block comprises a first locating block and a second locating block, the first locating block being aligned with a top face of the insulative housing or a top face of the first plastic body to mate with the first locating groove, and the second locating block being lower than the top face of the insulative housing or the top face of the first plastic body to mate with the first locating groove.

8. The LVDS connector according to claim 1, wherein a locating block protrudes and is thus formed on the front side face of the insulative housing, and a locating groove mating with the locating block is formed on a rear side face of the first plastic body.

9. The LVDS connector according to claim 8, wherein: the locating block comprises a first locating block and a second locating block; and the locating groove comprises a first locating groove and a second locating groove, the first locating block mating with the first locating groove, and the second locating block mating with the second locating groove.

10. The LVDS connector according to claim 1, wherein a bottom face of the insulative housing is provided with a holding groove, and a holding pad mating with the holding groove is formed on the second housing.

11. The LVDS connector according to claim 10, wherein: the holding groove comprises a first holding groove and a second holding groove, the first holding groove being an upwardly open groove, the second holding groove being a downwardly open groove, and a width of the second holding groove being greater than a width of the first holding groove; and the holding pad comprises a first holding pad and a second holding pad, the first holding pad and the second holding pad being both aligned with the second housing, and a width of the second holding pad being greater than a width of the first holding pad.

12. The LVDS connector according to claim 1, wherein a holding pad protrudes and is thus formed on a bottom face of the insulative housing, and a holding groove mating with the holding pad is formed on the second housing.

13. The LVDS connector according to claim 12, wherein: the holding pad comprises a first holding pad and a second holding pad, the first holding pad and the second holding pad being staggered arranged, the first holding pad being aligned with the bottom face of the insulative housing, and the second holding pad being aligned with the bottom face of the insulative housing; and the holding groove comprises a first holding groove and a second holding groove, the first holding groove and the second holding groove being staggered arranged, the first holding groove being an upwardly open groove, and the second holding groove being a downwardly open groove.

14. The LVDS connector according to claim 2, wherein a locating block protrudes and is thus formed on an outer side face of the base body end portion, and the outer side face is back to another base body end portion.

15. The LVDS connector according to claim 2, wherein a contact shrapnel is formed by inward extension towards the receiving space on one side of the bending portion.

16. The LVDS connector according to claim 2, wherein: a flat plate-shaped structure is formed by upward extension on the second housing, the flat plate-shaped structure being provided with a buckling piece; and a buckling hole mating with the buckling piece is formed by downward extension on the first housing.

17. The LVDS connector according to claim 2, wherein a securing piece is formed by extension at a rear end of the first housing; and a second locating groove mating with the securing piece is arranged on the insulative housing, the second locating groove being a downwardly open groove.

18. A connector, comprising:

a plurality of conductive terminals, each of the plurality of conductive terminals comprising a base portion and an elastic contact portion formed by extending from one end of the base portion, the elastic contact portion being configured to be electrically connected to an external plug;

an insulative housing, on which the plurality of conductive terminals are inlaid and insert molded, the elastic contact portion extending out of a front side face of the insulative housing in a suspension manner;

a shielding housing, comprising a receiving space, the insulative housing being assembled in the receiving space; and a first plastic body, insert molded on an inner side of the shielding housing, the first plastic body being configured to space apart the plurality of conductive terminals to prevent a short circuit; wherein a securing grapnel mating with a docking connector is formed on each of two ends of the shielding housing.

19. The connector according to claim 18, wherein a plurality of spacing bars protrude and are thus formed on a surface of the first plastic body back to the shielding housing, a groove for receiving the elastic contact portion of each of the plurality of conductive terminals being formed between each two adjacent spacing bars of the plurality of spacing bars.

* * * * *